US005164715A

United States Patent [19]

Kashiwabara et al.

[11] Patent Number: 5,164,715

[45] Date of Patent: Nov. 17, 1992

[54] COLOR DISPLAY DEVICE

[75] Inventors: Houichiro Kashiwabara, Hino; Ryouichi Akiyama, Kawasaki; Satoshi Nakagawa, Tokyo; Koutaro Yoneda; Izumi Funakoshi, both of Yokohama, all of Japan

[73] Assignee: Stanley Electric Co. Ltd., Tokyo, Japan

[21] Appl. No.: 7,691

[22] Filed: Apr. 10, 1990

[30] Foreign Application Priority Data

May 25, 1989 [JP] Japan ..... 1-130074

[51] Int. Cl.[5] ..... G09G 3/18

[52] U.S. Cl. ..... 340/716; 340/702; 340/782; 340/784; 340/815.1; 362/228

[58] Field of Search ..... 340/784, 782, 702, 716, 340/794, 795, 796, 815.1, 752; 313/754, 483, 501; 362/800, 84, 228; 358/901; 350/332, 333, 334, 339 F, 345

[56] References Cited

U.S. PATENT DOCUMENTS

| | | | |
|---|---|---|---|
| 4,170,772 | 10/1979 | Bly | 340/752 |
| 4,578,672 | 5/1986 | Oota et al. | 340/702 |
| 4,851,824 | 7/1989 | Murata | 340/782 |

*Primary Examiner*—Jeffrey A. Brier
*Assistant Examiner*—Jick Chin
*Attorney, Agent, or Firm*—Dykema Gossett

[57] ABSTRACT

A color display device comprises a blue color emitting light source consisting of a blue color emitting fluorescent lamp or a white color emitting fluorescent lamp attached with a blue color filter, and a liquid crystal panel for controlling the transmission of the blue color light for every pixel, wherein one end of every optical fiber provided for every pixel is fixed to a position on a fiber board where every blue color signal for every pixel passing through said liquid crystal panel can be incident, and the other end thereof is fixed to a corresponding position on a printed board on which a red color emitting LED and a green color emitting LED are mounted for every pixel, to have a full-color display by controlling the drive of said red color emitting LED, green color emitting LED and liquid crystal panel.

6 Claims, 2 Drawing Sheets

COLOR DISPLAY DEVICE

BACKGROUND OF THE INVENTION (1) Field of the Invention

This invention relates to a color display device which can obtain a bright full-color display screen with particularly low consumption.

(2) Description of the Prior Art

Full color display requires a light source with three primary colors (red, green and blue). Recently many light emitting diodes (LEDs) have been used for the light source to reduce power consumption. In applying these LEDs to a color display device, a red emitting LED, a green emitting LED and a blue emitting LED are attached on the printed board for every display pixel, and controlled by video signals, to obtain a desirable full-color display screen.

According to the conventional color display device using LEDs as the above-mentioned three primary colors light source, however, red and green LEDs are sufficient in brightness, but a blue LED cannot have the same level of brightness as compared to the red and green LEDs, thus failing to obtain an adequately bright and distinct display screen.

SUMMARY OF THE INVENTION

In view of the above problems, an object of the present invention is to provide a color display device which can obtain a bright and distinct full-color display screen with a low power consumption.

To achieve the above object, a color display device according to the invention comprises a blue emitting light source consisting of a blue color emitting fluorescent lamp or a white color emitting fluorescent lamp attached with a blue color filter, and a liquid crystal panel for controlling the transmission of the blue color light for every pixel, wherein one end of every optical fiber provided for every pixel is fixed to a position on a printed board where every blue color signal for every pixel passing through the above-mentioned liquid crystal panel can be incident, and the other end thereof is fixed to a corresponding position on a printed board on which a red color emitting LED and a green color emitting LED are mounted for every pixel, to have a full-color display by controlling the drive of the above mentioned red color emitting LED, green color emitting LED and liquid crystal panel. Further, in the above described color display device, the other end of the optical fiber may be fixed to a printed board after protruding through the above-mentioned printed board from the back surface to the front surface, and the above mentioned liquid crystal panel may have a varied light transmittance for every pixel.

The color display device according to the invention employs a fluorescent lamp for the blue color light source, thereby realizing a bright and distinct display screen, and employs LEDs for other light sources, thereby reducing power consumption.

DETAILED DESCRIPTION OF THE DRAWINGS

Figure 1A:
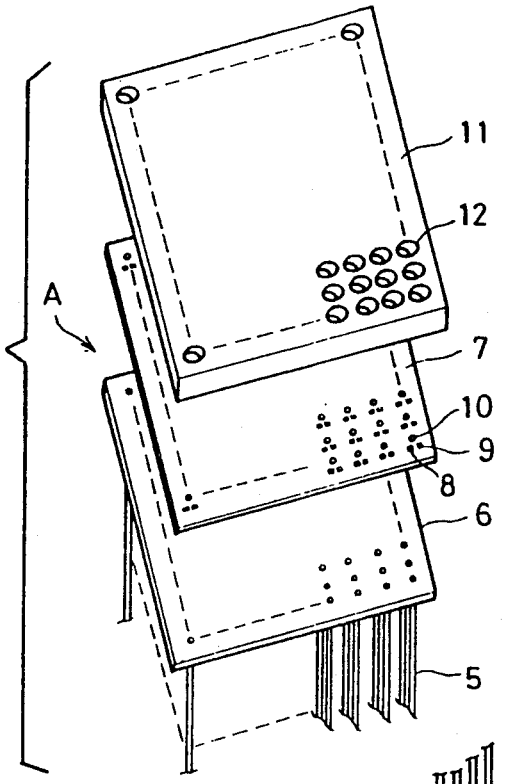
Figure 1B:
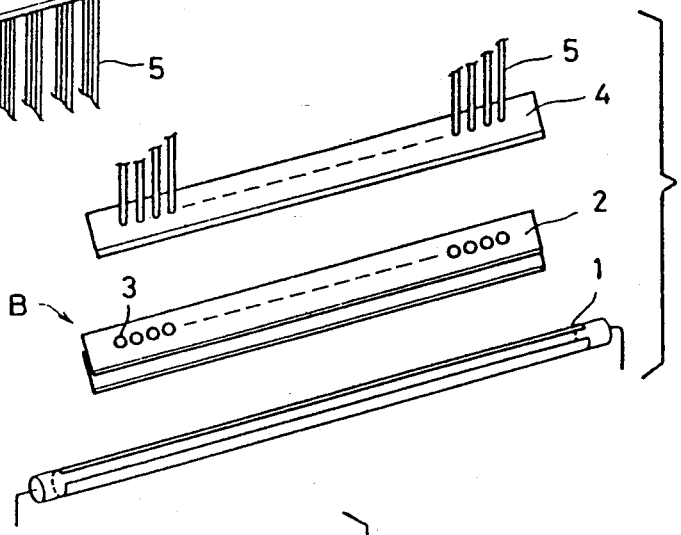
Figure 1C:
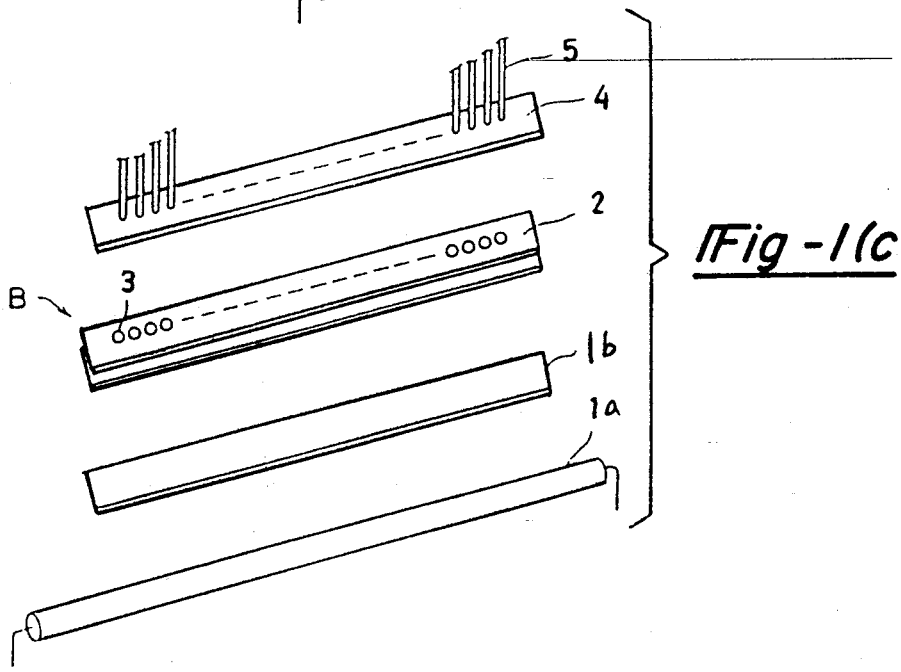
Figure 2:
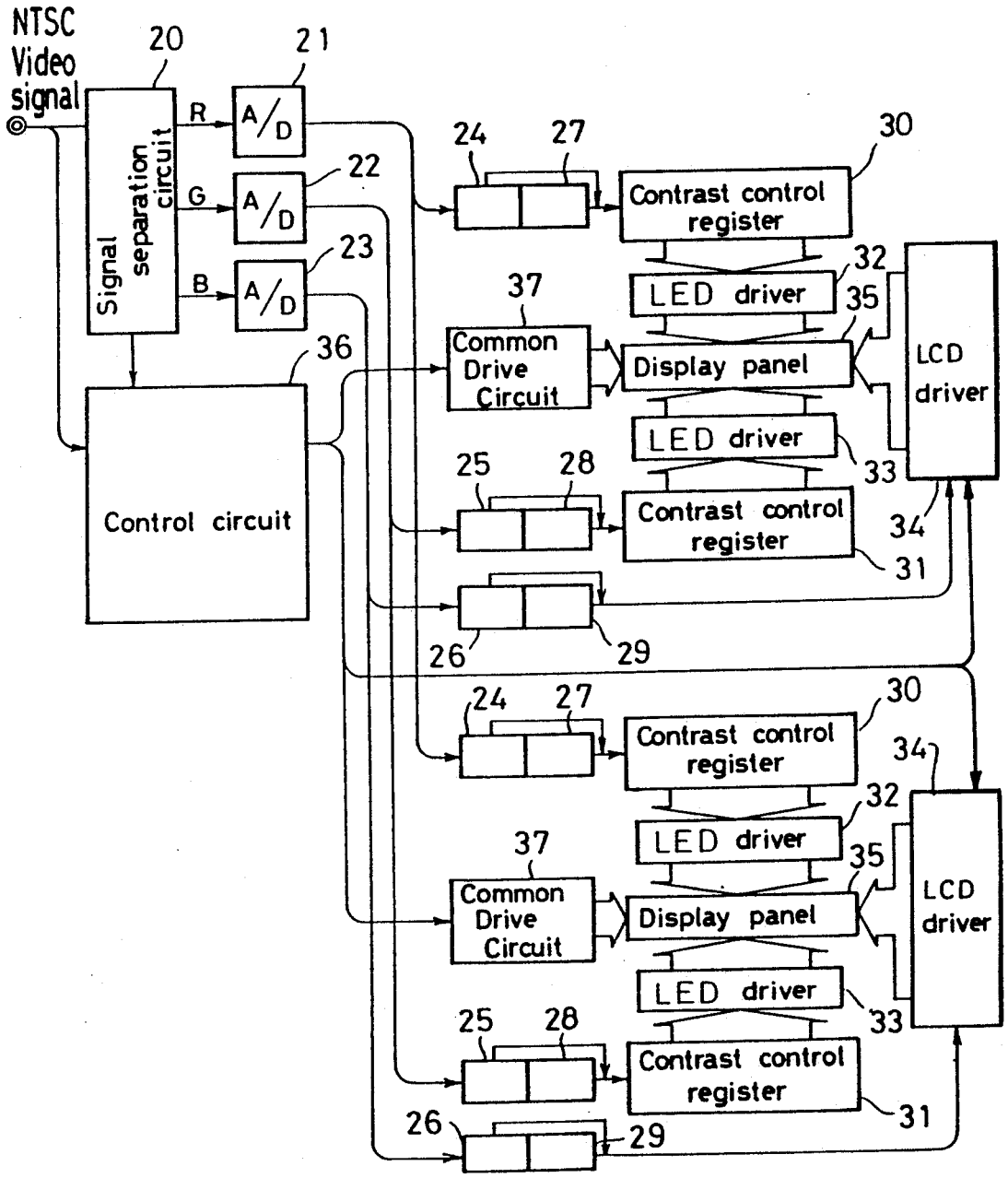

FIGS. 1 (*a*), 1 (*b*) and 1 (*c*) are exploded perspective views showing main parts of a color display device according to the invention; and FIG. 2 is a block diagram of the specific circuit configuration of the display device in FIG. 1.

DETAILED DESCRIPTION OF PREFERRED EMBODIMENT

FIG. 1 is an exploded perspective view showing major parts of an embodiment of a color display device according to the invention. FIGS. 1 (*a*) and 1 (*b*) show respectively the configuration of a display section A and a blue color light source section B. The blue color light source section B in FIG. 1 (*b*) shows only one portion corresponding to pixels in one line among all a matrix of display pixels.

In FIG. 1, Numeral 1 represents a bar-shaped blue color emitting fluorescent lamp, 2 represents a ferroelectric liquid crystal panel arranged close to (in front of) the fluorescent lamp 1, and a plurality of pattern electrodes are provided on the panel 2 in dots to control the transmission of a blue color light from the fluorescent lamp 1. Every dot 3 turns independently ON/OFF by an external signal and the transmittance of a blue color light can be changed. Numeral 4 is one fiber board attached with optical fiber 5 for every pixel. After passing the fiber board 4, one end of the optical fiber 5 is fixed to a position thereof, where a blue color signal for every pixel passing the liquid crystal panel 2 can be incident, and the other end thereof is provided so as to pass the other fiber board 6. Numeral 7 is a printed board attached with a red color emitting LED (chip) 8 and a green color emitting LED (chip) 9 for every pixel. The other end of the optical fiber 5 passes through a through hole 10 from the back side at a corresponding position on the printed board 7, protrudes on the front side and is fixed to the front surface of the- printed board 7. Numeral 11 is a reflection frame arranged in front of the printed board 7. The reflection frame 11 has cone-shaped holes 12 at positions corresponding to every pixel. The holes 12 function as lamp houses.

The blue color light source section B may replace the blue color emitting fluorescent lamp 1 with a combination of a white color emitting fluorescent lamp 1*a*, and a blue color passing filter 1*b*.

In the above-mentioned color display device, one dot (pixel) on the display screen consists of a red color LED 8, a green LED 9 and a blue color optical fiber 5 to form a display screen constituted of a matrix of plural dots. Control of the brightness of the LEDs 8, 9 and the transmittance of the liquid crystal panel 2 can obtain a desirable full-colour display screen, when, since the front surface of the printed board 7 in the display section A is provided with the reflection frame 11 provided with cone-shaped holes 12 for all pixels, a light from every light source can be taken out effectively. Further, since the fluorescent lamp 1 is used for obtaining a blue color light, and spontaneously emitting light elements or LEDs 8 and 9 having single wavelengths are used for obtaining red and green color lights, the color display device according to the invention can obtain a bright and distinct full-color display screen and minimize the power consumption with extended life. Further its rapid response can process video signals in a real-time basis.

Now, the operation of the color display device according to the invention will be described in detail:

FIG. 2 is a block diagram showing a specific circuit configuration of the display device shown in FIG. 1, which can be used for processing television video signals.

When a video signal of NISC system is inputted to the display device, the signal is divided into analog luminance signals for R (red), G (green) and B (blue) by a signal separation circuit 20. The separated analog luminance signals are converted into digital signals by analog/digital (A/D) converters 21 to 23, and the coverted digital signals are respectively stored in display memories 24 to 26. While signals for one screen are stored, among R, G and B signals for the preceding screen prestored in display memories 27 to 29, R and G signals are sent respectively to LED drivers 32, 33 consisting of FETs through contrast control registers 30, 31, and a B signal is sent directly to a LCD driver 34. Receiving these signals, the drivers 32 to 34 drive the LED chips 8, 9 and the liquid crystal panel 2 to display an image on a display panel 35, when a control circuit 36 outputs timing signals to the drivers 32 to 34 and a common drive circuit 37 according to the video signal and a synchronism signal from the signal separation circuit 20 to control the display panel 35. When the display of the screen is completed, the R, G and B signals stored in the display memories 24 to 26 are sent to the driver 32 to 34, to display an image on the display panel 35, and then signals for a next screen are stored in the display memories 27 to 29 as described above.

FIG. 2 shows an example which has two display circuits. With a large display capacity, each of the display circuits may be further divided into two or more circuits to constitute an entire screen with a plurality of screens.

This invention can be applied not only to television and the video system, but also to the display monitor of a personal computer, the monitor for television game, the commercial or advertisement display device, etc.

The color display device according to the invention employs a green color emitting LED, a green color emitting LED and a fluorescent lamp for emitting blue color, thereby resulting in obtaining a bright and distinct full-color display screen with a low power consumption

What is claimed is:

1. A color display device comprising:

a blue color emitting light source consisting of a blue color emitting fluorescent lamp or a white color emitting fluorescent lamp attached with a blue color filter, a liquid crystal panel for controlling a transmission of the blue color light;

an optical fiber having a first end positioned on a fiber board where said blue color light, passing through said liquid crystal panel can be incident, said optical fiber having a second end being fixed to a corresponding position on a printed board on which a red color emitting LED and a green color emitting LED are mounted, said printed board being adapted to produce a full-color display by controlling a drive of said red color emitting LED, green color emitting LED, and said liquid crystal panel.

2. A color display device as claimed in claim 1, wherein the other end of the optical fiber is fixed to a printed board after protruding through said printed board from the back surface to the front surface.

3. A color display device as claimed in claim 1, wherein the light transmittance of said liquid crystal panel is variable.

4. A color display device comprising:

a blue colored light emitting source;

liquid crystal panel means, coupled to said emitting source, for selectively transmitting certain discrete portions of said emitted blue colored light;

a plurality of optical fibers, each of said fibers having a first end fixed to a unique position on a fiber board and adapted to receive said certain discrete portions of said blue colored light, each of said plurality of optical fibers further having a second end fixed to a unique and certain position on a printed board on which a plurality of red colored light emitting diodes and a plurality of green colored light emitting diodes are mourned, said printed board being adapted to produce a full-color display for controlling a device of said red colored light emitting diode, said green colored light emitting diodes, and said liquid crystal panel.

5. a color display device as claimed in claim 4, wherein the second end of each of said plurality of optical fibers is fixed to said printed board after protruding through said printed board from the back surface to the front surface thereof.

6. A color display device as claimed in claim 4 wherein, said liquid crystal panel means comprises a plurality of pattern electrodes.

* * * * *

UNITED STATES PATENT AND TRADEMARK OFFICE

CERTIFICATE OF CORRECTION

PATENT NO. : 5,164,715

DATED : November 17, 1992

INVENTOR(S) : Kashiwabara, et al.

It is certified that error appears in the above-identified patent and that said Letters Patent is hereby corrected as shown below:

Cover Page - [21] Appl. No.: 7,691 should read

[21] Appl. No.: 507,691

Signed and Sealed this

Sixteenth Day of November, 1993

*Attest:*

*Attesting Officer*

Bruce Lehman

BRUCE LEHMAN

*Commissioner of Patents and Trademarks*